United States Patent [19]

Watsky

[11] 4,116,253

[45] Sep. 26, 1978

[54] SNATCH PROOF HANDLE FOR POCKETBOOKS, HANDBAGS AND THE LIKE

[76] Inventor: Benjamin Watsky, 137-28 Northern Blvd., Flushing, N.Y. 11354

[21] Appl. No.: 807,900

[22] Filed: Aug. 1, 1977

[51] Int. Cl.[2] ..... A45C 13/26

[52] U.S. Cl. ..... 150/33; 150/12; 224/45 P

[58] Field of Search ..... 150/33, 47, 12, 1.7, 150/7; 224/45 E, 45 H, 45 M, 45 N, 45 P, 47

[56] References Cited

U.S. PATENT DOCUMENTS

| | | | |
|---|---|---|---|
| 1,550,470 | 8/1925 | Tilden | 150/1.7 |
| 1,768,725 | 7/1930 | White | 150/33 |
| 2,716,558 | 8/1955 | Sullivan | 150/1.7 |
| 3,203,551 | 8/1965 | Van Loan | 150/7 |
| 3,976,113 | 8/1976 | Kim | 150/12 |

FOREIGN PATENT DOCUMENTS

| | | | |
|---|---|---|---|
| 435,862 | 1/1912 | France | 150/47 |
| 27,576 of | 1908 | United Kingdom | 150/33 |

*Primary Examiner*—Herbert F. Ross
*Attorney, Agent, or Firm*—Richard L. Miller

[57] ABSTRACT

A handle for a hand-carried article such as a handbag, pocketbook or the like; the handle consisting of two straps, one of which is secured to each opposite side of the article, each strap being twisted to form a loop through which a person's hand can be inserted, and each loop being stretchable so to fit different sizes of hands.

1 Claim, 5 Drawing Figures

SNATCH PROOF HANDLE FOR POCKETBOOKS, HANDBAGS AND THE LIKE

This invention relates generally to handbag and pocketbook handles.

A principal object of the present invention is to provide a handle that can be more firmly held by a hand so as to foil a thief or purse snatcher who attempts to seize same.

Another object is to provide a handle designed for a firm hold to person's hand, and which does not require any physical strength by the person, so that it is equally effective for use by old and weak persons, as well as by others.

Still another object is to provide a handle which is adjustable in size in order to readily accommodate larger or smaller hands.

Still a further object is to provide a handle that allows a person to keep his grasping muscles in a relaxed position while supporting the handle.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

Figure 1:
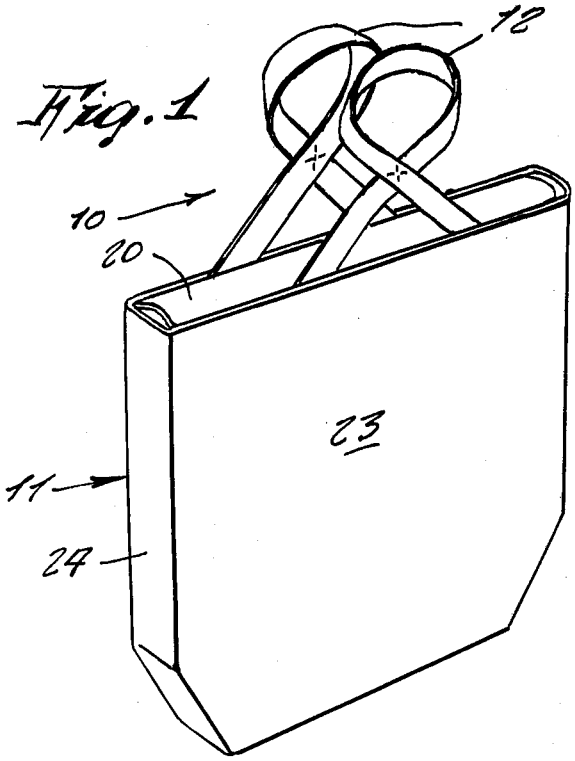
FIG. 1 is a perspective view of the invention showing the bag closed.

Referring now to the drawings in greater detail, the reference numeral 10 represents a snatch-proof handle according to the present invention wherein the same is mountable upon a handbag 11, as shown, or else on a purse or other normally handheld object.

As shown in the drawings, the handle consists of a pair of straps 12 each one of which is secured to opposite flat sides 13 of the handbag in order to surround the handbag opening 14 therebetween, and thus protecting the opening from easy access by an unauthorized person when both straps are being held.

Each strap is made of a strong flexible material such as leather, canvas, or the like, and is secured at its opposite ends 15 to the handbag while a center of the strap is provided with a one-half turn twist in order to form a loop 16 into which a person can fully insert a hand 17. The loop is permanently retained in the strap by means of a stitch 18 sewn through the junction of the crossing portions 19 of the strap.

Figure 2:
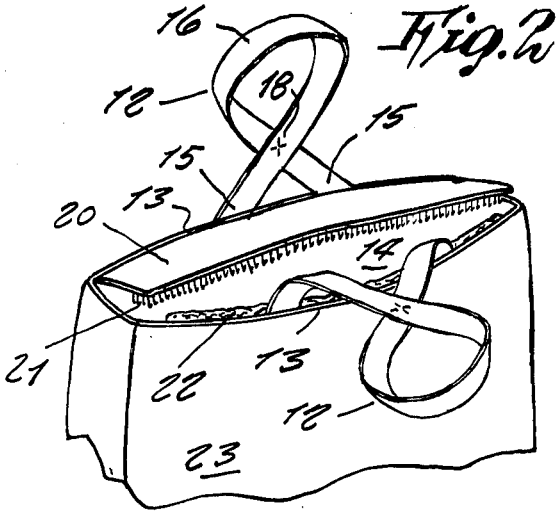
FIG. 2 is a similar view showing the bag open.

The handbag in the design illustrated in FIGS. 1 and 2, includes a flap 20 for selectively closing the opening 14; the flap being secured along its one long edge to one side 13, while an opposite edge pf the flap has a hooked Velcro element 21 secured thereto for engaging a matted Velcro element 22 secured to the opposite side 13 of the handbag.

The body of the handbag includes opposite side panels 23 and a narrow edge panel 24, therebetween.

In operative use, a person inserts a hand 17 completely through both of the loops 16 so that the loop extends around the wrist 18 in order that the weight of the handbag thus rests upon the shoulds 25 of the hand as is not supported by the force of fingers grasping the handle. Thus a heavy load can be comfortably carried by anyone who has a weak, grasping force, such as persons who are old, or tired. The fingers 26 are simply wrapped around the loop for controlling the handbag position only. Likewise, a thief cannot readily pull off the handle.

Figure 3:
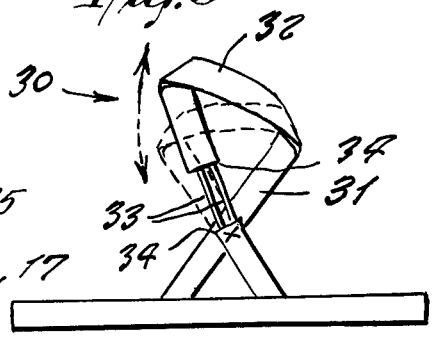
FIG. 3 is a modified design of the invention.
Figure 4:
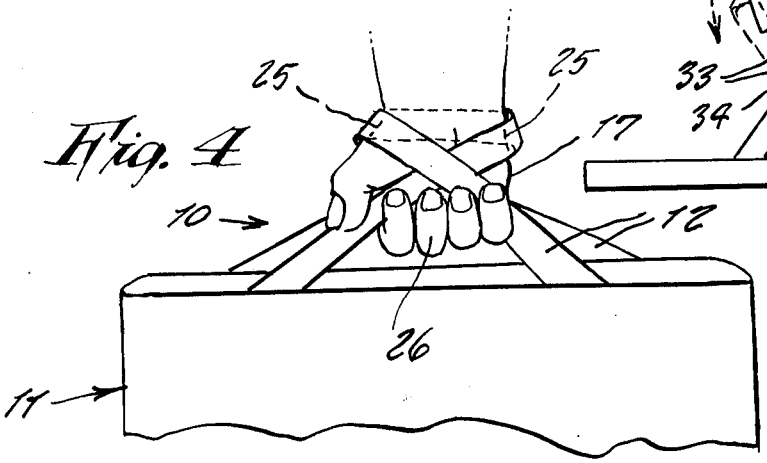
FIG. 4 is a side view showing the hand, grasping the handle.
Figure 5:
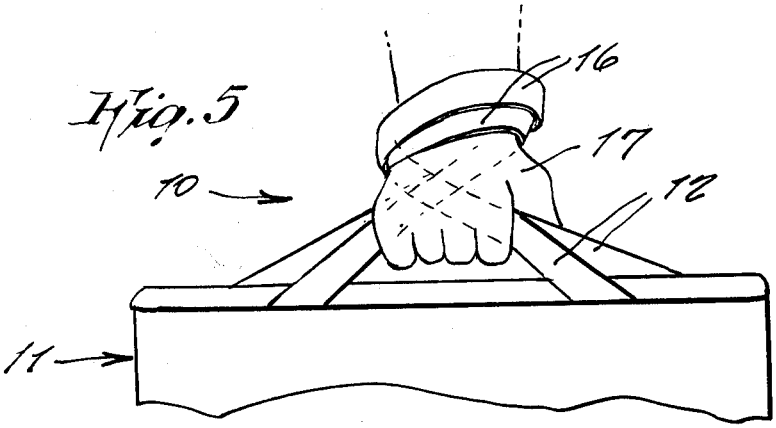
FIG. 5 is an opposite, side view thereof.

In a modified design of the invention illustrated in FIG. 3, the handle 30 has straps 31, each of which has an expandable loop 32, by means of stretchable tapes 33 between ends 34 in order that the loop fits larger hands. The straps may each be comprised of rolled up flexible material, stitched into a tubular shape so to enclose the tapes so that when not stretched, the tapes are hidden inside.

While certain novel features of this invention have been shown and described, and are pointed out in the annexed claims, it will be understood that various omissions, substitutions, and changes in the forms and details of the device illustrated, and in its operation, can be made by those skilled in the art, without departing from the spirit of the invention.

What is claimed is:

1. An article of manufacture, comprising in combination, a hand-supported object such as a handbag, and a pair of handles attached to said handbag, said handles incorporating means to prevent readily falling from a persons hand or being forcibly pulled away therefrom; said handbag comprising a body of a pair of opposite side panels and a narrow side and bottom edge panel therebetween, an opening at a top of said handbag being selectively closable by a flap secured to one side panel of said handbag and being attached to the opposite side panel thereof by interconnectable Velcro elements, said handles being comprised of a pair of straps, one of said straps secured at its opposite ends to one of said sides of said handbag and the other of said straps secured at its opposite ends to the other side of said handbag, a longitudinal center portion of each strap is twisted one-half way around to form a loop with a crossing junction closing said loop, said crossing junction being stitched thereby forming said loop, said loops being vertically aligned in use and being of a size to receive an entire hand of a person up to his wrist and encircle the wrist from opposite sides of said handbag, each strap is of tubular construction, each strap at its loop being parted so to form a pair of loop ends, a plurality of stretchable tapes between said loop ends, opposite ends of said tapes being secured inside said tubular strap, and said tapes being of a length so that when relaxed from stretch, said loop ends abut and hide said tapes.

* * * * *